US005265516A

United States Patent [19]

Usa et al.

[11] Patent Number: 5,265,516

[45] Date of Patent: Nov. 30, 1993

[54] ELECTRONIC MUSICAL INSTRUMENT WITH MANIPULATION PLATE

[75] Inventors: Satoshi Usa; Tetsuo Okamoto; Eiichiro Aoki, all of Hamamatsu, Japan

[73] Assignee: Yamaha Corporation, Hamamatsu, Japan

[21] Appl. No.: 628,341

[22] Filed: Dec. 14, 1990

[30] Foreign Application Priority Data

Dec. 14, 1989 [JP] Japan ..... 1-324628

[51] Int. Cl.[5] ..... G10H 3/14

[52] U.S. Cl. ..... 84/600; 84/622; 84/626; 84/645; 84/658; 84/659; 84/662; 84/734

[58] Field of Search ..... 84/723, 743, 600, 644, 84/626, 622, 659, 662, 670, 734, 735, 645, 726, 725, 658

[56] References Cited

U.S. PATENT DOCUMENTS 3,621,214 11/1971 Romney et al. ..... 235/151
4,242,937 1/1984 Pozar ..... 84/725
4,776,253 10/1988 Downes ..... 446/242 X
4,805,510 2/1989 De Dianous ..... 84/723
4,882,965 11/1989 McClish ..... 84/726
4,968,877 11/1990 McAvinney et al. ..... 84/645 X
4,980,519 12/1990 Mathews ..... 84/735 X

FOREIGN PATENT DOCUMENTS 0286747 10/1988 European Pat. Off. ..... 84/658
48-42963 12/1973 Japan .
63-40199 2/1988 Japan .

OTHER PUBLICATIONS

Ellis, "Calculus with Analytic Geometry", Harcourt Brace Jovanovich Inc., 1982, p. 458.

*Primary Examiner*—William M. Shoop, Jr.
*Assistant Examiner*—Brian Sircus
*Attorney, Agent, or Firm*—Graham & James

[57] ABSTRACT

An electronic musical instrument having a manipulator which includes a hand manipulator and manipulation region capable of setting a reference point and/or reference axis, adapted for generating the musical tones of a rubbed string instrument. The distance from the reference point to the position of performance manipulation and/or the angle between the line connecting the reference point with position of performance manipulation and the reference axis may be calculated to produce parameters for controlling the musical tone signal, such as the bow pressure and the direction of the bow movement.

15 Claims, 9 Drawing Sheets

ELECTRONIC MUSICAL INSTRUMENT WITH MANIPULATION PLATE

BACKGROUND OF THE INVENTION a) Field of the Invention

This invention relates to an electronic musical instrument and more particularly to an electronic musical instrument adapted for generating parameters for controlling the musical sounds of a rubbed string instrument or a wind instrument.

b) Description of the Related Art

Most of the real time performance manipulators of the electronic musical instruments have been made of keyboards. A keyboard has a plurality of keys corresponding to the respective tone pitches. When a key in the keyboard is depressed, an associated key switch is closed (made) to generate a pitch signal corresponding to the tone pitch assigned to the depressed key.

In the case of a two-make switch, the first and the second key switches are closed (made) successively at a speed corresponding to the key depressing speed. Upon the make actions of the two switches, a tone pitch signal corresponding to the depressed key and a touch signal corresponding to the speed of the key depressing action derived from the make time difference between the first and the second key switch makings are generated. Those electronic musical instruments equipped with such keyboard are adapted to simulate the musical sounds of the keyboard instruments such as the piano and the organ.

Other electronic musical instruments include guitar synthesizer, wind controller, etc. The guitar synthesizer is adapted to simulate the musical sounds of the guitar. The wind controller is adapted to simulate the musical sounds of the wind instruments.

A rubbed string instrument such as violin changes the expression of the musical sound in a variety of ways, based on the speed of the string rubbing bow and the pressure of the string pressing bow.

When the musical sound of such a rubbed string instrument is to be simulated by an electronic musical instrument, roughly two ways can be thought of.

One is the method in which such basic performance manipulators of a rubbed string instrument as bow, string and fingerboard are directly used and, for example, the vibration of a string is transformed into an electric signal and treated electronically. The other is the method in which, without using bow, string and fingerboard, etc. of the natural rubbed string instrument, a performance manipulator or manipulators such as a keyboard, different from those of the natural rubbed string instrument, are used as the basic performance manipulators and a musical sound is simulated based on the performance of such manipulators.

When the bow, the string and the fingerboard similar to those of the natural musical instrument are used as the performance manipulators to cause actual vibrations of a string according to the former method, a rubbed string electronic musical instruments capable of achieving performance rich in expression can be realized. However, the performance using the performance manipulators similar to those of the natural rubbed string instrument requires techniques of a high grade, and long term exercise for its mastering. Therefore, those who are not well-trained in performance techniques cannot enjoy the performance of the rubbed string instrument.

According to the latter method, for example, the harmonics construction of the basic tone color of the violin are preliminarily studied to enable electronic synthesis of the basic musical sound. Then, the sounds of the violin, etc. are generated in response to the keyboard manipulation. Whereas the sound of the violin changes its musical expression in a variety of ways according to its bow speed, bow pressure, etc. while the bow is contacting the string, keyboard input has no function for giving such expressions. Thus, the performance is apt to become monotonic and poor in expression.

Japanese Patent Laid-Open Sho. 63-40199 discloses a wind instrument which generates the musical sound in correspondence to the breath pressure, and the embouchure (Ansatz, representing the form of the lips, the lower facial muscles and the structure of jaws and teeth). Such a wind instruments not fitted for generating the information required for controlling the musical sound of a rubbed string instrument.

As is described above, according to the conventional technique, the kinds of the controlling information which the keyboard type electronic musical instrument can generate are few, and are not sufficient for the performance of the rubbed string instruments, etc. The guitar synthesizer and the wind controller are adapted for the performances of the guitar and the wind instrument, but have limitations for achieving performance of other kinds of instruments.

SUMMARY OF THE INVENTION

An object of this invention is to provide an electronic musical instrument capable of forming parameters for controlling the musical sounds by novel performance manipulation.

Another object of this invention is to provide an electronic musical instrument capable of enhancing the generation of musical sounds rich in expression of the rubbed string instrument.

According to an aspect of this invention, there is provided an electronic musical instrument comprising, manipulation means for achieving performance manipulation therein, having a manipulation region of at least two dimensions, and being capable of setting a reference point in the manipulation region, means for detecting a distance from said reference point to a position of performance manipulation, and means for generating a tone signal, capable of generating a tone signal using said distance from the reference point as a parameter of controlling the tone signal.

Further, there is provided an electronic musical instrument as mentioned above, further comprising, means for detecting a speed of said performance manipulation from time variation of the position of performance manipulation in said manipulation region, wherein said tone signal generating means is capable of generating a tone signal utilizing the speed of the performance manipulation and the distance from the reference point.

Further, there is provided an electronic musical instrument as mentioned above, further comprising means for generating a pressure signal based on said distance from the reference point, and said tone signal generating means is capable of generating a tone signal using the speed and the pressure as parameters for controlling the signal.

Also, there is provided an electronic musical instrument comprising, manipulation means for achieving performance manipulation therein, having a manipulation region of at least two dimensions, and being capable of setting a reference point and one axis including said reference point as origin in the manipulation region, means for detecting a distance from said reference point to a position of performance manipulation, means for detecting time variation of an angle formed between the direction connecting the position of performance manipulation and the origin and said axis, means for generating a tone signal, capable of generating a tone signal using said distance from the reference point and said angle as parameters of controlling the tone signal.

In a rubbed string instrument, musical sounds are generated by moving a bow up and down, while rubbing a string with acertain pressure. Namely, the musical sound is changed with rich expression by bow speed, bow pressure, etc. When such musical sounds of a rubbed string instrument are to be simulated in an electronic musical instrument, information of bow speed, bow pressure, etc. are desired as parameters for controlling the musical sound.

Similarly, breath pressure, embouchure (An satz), etc. is desired in a wind instrument.

Using manipulation means having a manipulation region of at least two dimensions for achieving performance manipulation therein, and utilizing a distance from the reference point to the position of performance manipulation as a parameter for controlling the tone signal, control of the tone of a rubbed string instrument is made easy. For example, the distance may be used for generating a bow pressure data so that a bow pressure data varying arbitrarily can be easily produced. Generation of a musical sound of a rubbed string instrument rich in expression is made easy, for example by detecting time variation of the position of performance manipulation in the manipulation region to obtain information representing the bow speed of a rubbed string instrument, together with the distance from the reference point to the position of performance manipulation representing the bow pressure, and forming a tone signal based thereon.

By utilizing the distance from the reference point to the position of performance manipulation as a bow pressure information, a pressure information can be generated without having pressure detecting means in the manipulation means. Therefore, an electronic musical instrument capable of simulating a rubbed string instrument can be constructed with a simple structure.

Further, by defining an angle of the position of performance manipulation, another tone signal controlling parameter can be made from the variation of the angle. For example, from the sign of the angle variation, an information regarding the direction of bow movement of a rubbed string instrument can be made.

BRIEF DESCRIPTION OF THE DRAWINGS

FIGS. 3A and 3B illustrate the characteristics of the non-linear circuit, wherein FIG. 3A is a graph for illustrating the functions of the division circuit 44 and the multiplication circuit 46 for altering characteristics of the non-linear circuit 45, and FIG. 3B is a graph showing the hysteresis characteristic given by a feedback loop.

Figure 1:
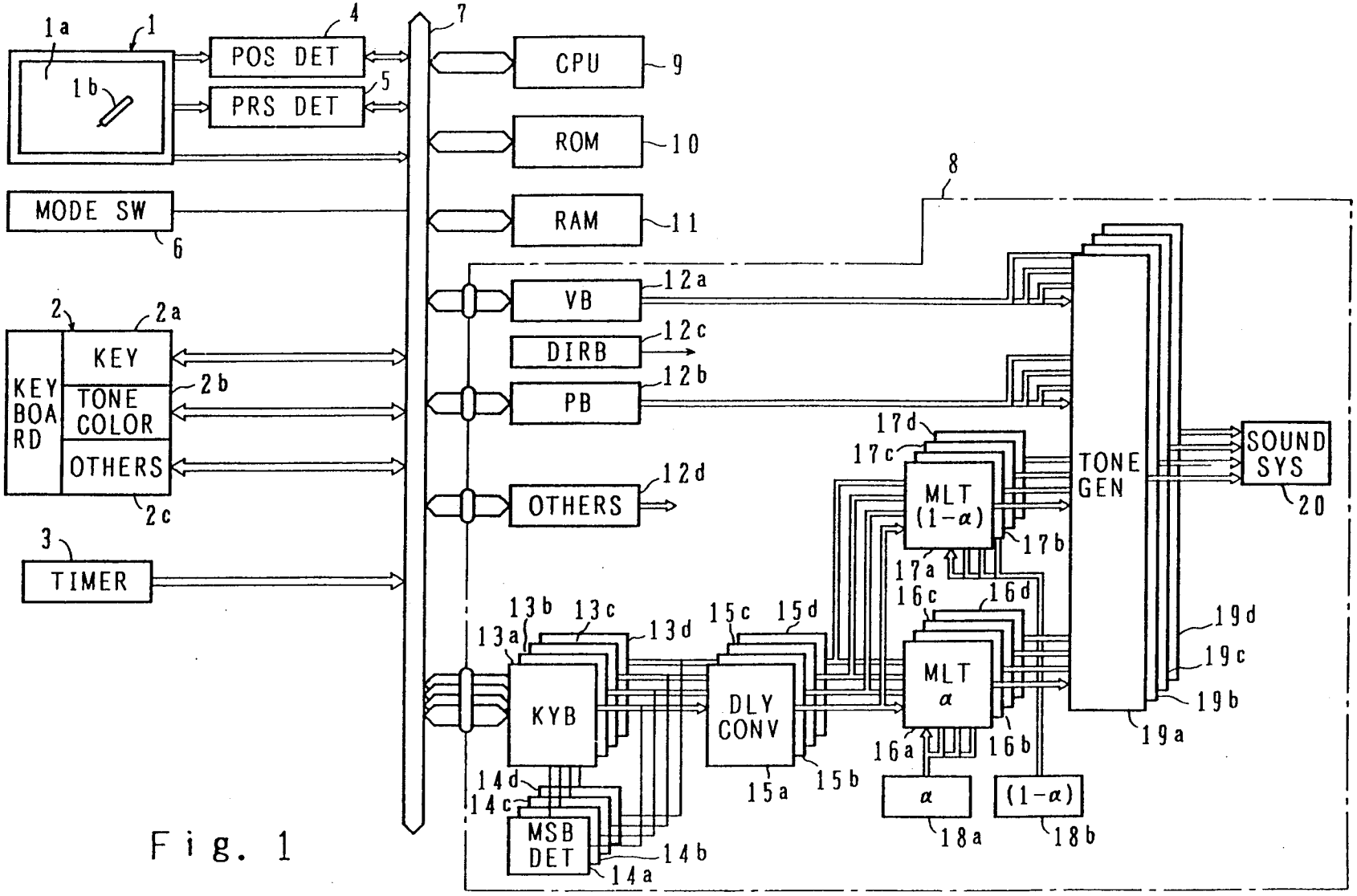
FIG. 1 is a block diagram of a hardware structure of an electronic musical instrument.

In the drawings, reference numerals denote the followings: 1 plane manipulator (manipulation means), 1*a* manipulation region, 1*b* hand manipulator, 2 keyboard, 2*a* key, 2*b* tone color pad, 2*c* other manipulator, 3 timer, 4 coordinate detector, 5 pressure detector, 6 mode switch, 7 bus, 8 tone signal generating circuit (tone signal generating means), 9 CPU, 10 ROM, 11 RAM, 12*a* velocity buffer, 12*b* pressure buffer, 12*c* direction buffer, 12*d* other buffer, 13 key buffer, 14 MSB detecting circuit, 15 delay conversion circuit, 16,17 multiplication circuit, 18 coefficient circuit, 19 tone generator, and 20 sound system.

DESCRIPTION OF THE PREFERRED EMBODIMENTS

FIG. 1 shows a hardware construction of an electronic musical instrument according to an embodiment of this invention adapted for generating musical sounds of a rubbed string instrument. In a plane manipulator 1, a movable hand manipulator 1*b* of a pen shape is manipulated on a manipulation region of a flat plane shape (tablet, or means for receiving manipulation by a manipulator) 1*a*. The plane manipulator 1 has a function of detecting the position in the manipulation region designated by the hand manipulator and a pressure given by the hand manipulator, such as the position where the pen point makes contact and the pressure which the pen point gives, etc. The coordinate information in the manipulation plane of the contact point of the pen shaped hand manipulator 1*b*, the pressure information of the force by which the hand manipulator 1*b* is depressed on the manipulation region 1*a*, etc. are supplied to a bus 7 through a coordinate a position detector 4, and a pressure detector 5, etc. The coordinate information, once detected, can produce other parameters such as speed information, distance information, direction information, etc. through predetermined processings. The distance information may be used as pressure information, for example. A keyboard 2 includes a multiplicity of keys 2*a* for designating a tone pitch, tone color pads 2*b* for designating a tone color by the name of the musical instrument, etc. and other manipulators 2*c* for designating other functions, and supplies the respective informations to the bus 7. A timer 3 supplies the timing information for issuing the timer interrupt to the bus 7.

A mode switch 6 is a change-over switch for selecting whether the pressure information is derived from the pressure detecting function of the plane manipulator 1 or is calculated from the processing using the position of performance manipulation as described later.

Further, a CPU 9 for performing predetermined processing treatment, a ROM 10 for storing the program to be executed in the CPU, etc., a RAM 11 including various kinds of registers and work memories etc. for storing various kinds of temporary information to be used for executing the program, and a tone signal generating circuit 8 are connected to the bus 7.

Here, the ROM 10 stores a program for generating the musical sound, and the CPU 9 performs the musical sound synthesizing processing utilizing the registers in the RAM 11, etc.

The tone signal generating circuit 8 includes a velocity buffer VB 12*a* for receiving the velocity information form the bus 7, a pressure buffer PB 12*b* for receiving the pressure information from the bus 7, a direction buffer DIRB 12*c* for receiving the direction information from the bus 7, other buffers 12*d* for receiving other information such as performance mode, tone color, etc. from the bus 7, which supply the velocity information, the pressure information, the direction information and other information to the tone generators 19*a*, 19*b*, 19*c*, and 19*d*. Although a structure is shown in which a plurality of tone generators are provided, one tone generator can do similar functions when time sharing control is employed.

The tone pitch information given by manipulating a key 2*a* in the keyboard 2 is stored in key buffers KYB 13*a*, 13*b*, 13*c* and 13*d*. Here, four key buffers are provided in correspondence to the four strings of a rubbed string instrument such as violin and viola. The key data stored in the key buffers KYB 13*a* to 13*d* includes the most significant bit MSB representing the on/off of the key and remaining bits of the pitch data representing the pitch.

The MSB detecting circuits 14*a* to 14*d* detect the MSB of the key data. If MSB="1" (key on), the key data is stored in the key buffer 13*a* to 13*d*. Here, the MSB may be removed from the stored data (may not be stored). The pitch data are sent to the corresponding delay varying circuits 15*a* to 15*d* and supplied to the tone generators 19*a* to 19*d* through multiplication circuits 16*a* to 16*d* and 17*a* to 17*d*.

The delay varying circuits 15*a* to 15*d* decrease the number of stages of delay when pitch is high and increase the number delay stages when the pitch is low so that the number of circulation of the tone signal in a circuit, which will be described later, in a predetermined time (frequency) is changed.

In the multiplication circuits 16*a* to 16*d*, a predetermined coefficient $\alpha$ is multiplied to the inputted pitch. In the multiplication circuits 17*a* to 17*d*, another predetermined coefficient $(1-\alpha)$ is multiplied to the inputted pitch. These two multiplications represent that a string of a rubbed string instrument from the bridge to the depressed finger position on the fingerboard may be divided into two portions at the position where the bow rubs the string.

Namely, that the addition of the two coefficients makes 1 represents the basic length from the depressed finger position to the bridge which determines the pitch. When one coefficient $\alpha$ corresponds to the distance from the string rubbing position to the bridge, the other coefficient $(1-\alpha)$ will correspond to the distance from the string rubbing position to the depressed finger position. In this way, the information representing the pitch is supplied to the tone generators 19*a* to 19*d*.

The velocity buffer 12*a* is a register temporarily storing the velocity information derived from the moving velocity of the hand manipulator 1*b* on the manipulation region 1*a* in the plane manipulator 1.

The pressure buffer 12*b* is a register for temporarily storing a pressure information obtained from the pressure with which the hand manipulator 1*b* is depressed to the manipulation region 1*a*, or the pressure information obtained from the distance from the reference position to the manipulation position in the manipulation region 1*a*. The direction buffer DIRB 12*c* temporarily stores a direction information obtained from the change of the angle of the manipulation position.

Tone signals are generated in the tone generators 19*a* to 19*d* based on the velocity information, the pressure information, the direction information together with the pitch information, and supplied to a sound system 20 to generate the musical sound. Here, each of the tone generators 19*a* to 19*d* includes a formant filter for simulating the behavior of the belly of the rubbed string instrument. The sound system 20 includes means for transforming the digital musical sound signal to an analog signal, means for amplifying the analog signal and means for transforming the electric signal into an acoustic signal.

In this way, musical sounds of a rubbed string instrument which can be varied its expression in a variety of ways in correspondence to the bow speed and the bow pressure can be generated.

Now, among the registers provided in the RAM, major ones will be explained hereinbelow.

Mode register (MD)

This is a register for storing data representing the information on the mode of pressure information mode which is changed over by the mode switch. This data represents which is selected as the pressure information, one detected from the actual pressure given to the plane manipulator 1 or one produced by processings based on the position of manipulation.

Event buffer register (EVTBUF)

This is a register for storing key event data corresponding to key depression and key release of a key 2*a* in the keyboard, and includes an on/off data and key data representing the tone pitch. In the case of a rubbed string instrument, four event buffer registers are provided to enable storing of four key events, considering the case where four strings are performed simultaneously. These buffers play the role of storing the tone pitch data temporarily.

X position register (X)

This is a register for storing the X directional position xp of the current or present manipulation position of the hand performance manipulator 1*b* in the tablet 1*a* which forms a plane for receiving manipulation.

X position register (xn)

This is a register for storing the X directional position xn of the hand performance manipulator 1*b* at the time of previous timer interrupt.

Here, the transition distance in the X direction can be calculated from the values of the X directional positions xp and xn at the current and the previous timer interrupts.

Y position register (Y)

This is a register for storing the Y directional position yp of the current manipulated position of the hand performance manipulator 1*b* in the tablet 1*a*.

Y position register (yn)

This is a register for storing the Y directional position yn of the hand performance manipulator 1*b* at the time of previous timer interrupt.

The transition distance in the Y direction can be calculated from the two values of the Y directional position Yp of the current timer interrupt and the Y directional position yn at the previous timer interrupt.

Velocity register (V)

This is a register for storing the velocity representing the bow speed. This register stores the velocity information derived from the transition distance based on the X directional transition distance and the Y directional transition distance as described above (and by dividing it by time).

Pressure register (P)

This is a register in the RAM for storing the pressure data derived from the output P0 of the pressure sensor provided in the plane manipulator 1 or the pressure data produced by processings from the position of performance manipulation.

Angle register ($\theta$)

This is a register for storing the angle data calculated by processings from the position of performance manipulation of the plane manipulator 1.

Angle register ($\theta$n)

This is a register for storing the angle data at the time of the previous timer interrupt.

Direction register (dir)

This is a register for storing the direction data calculated by processings from the variation of the angle data.

In the tone signal generating circuit 8, there are also provided a velocity buffer VB, a pressure buffer PB, a direction buffer DIRB, etc.

Flag OLD Register

This is a register for storing 1 or 0 representing that the flag OLD is set or reset. If this flag is 1, it means that the phenomenon represented by this flag has already been detected and this is the timer interrupt of the second and on time.

Also, there are provided in the RAM other registers for storing various constants and variables, but the description thereof are omitted here.

Figure 2:
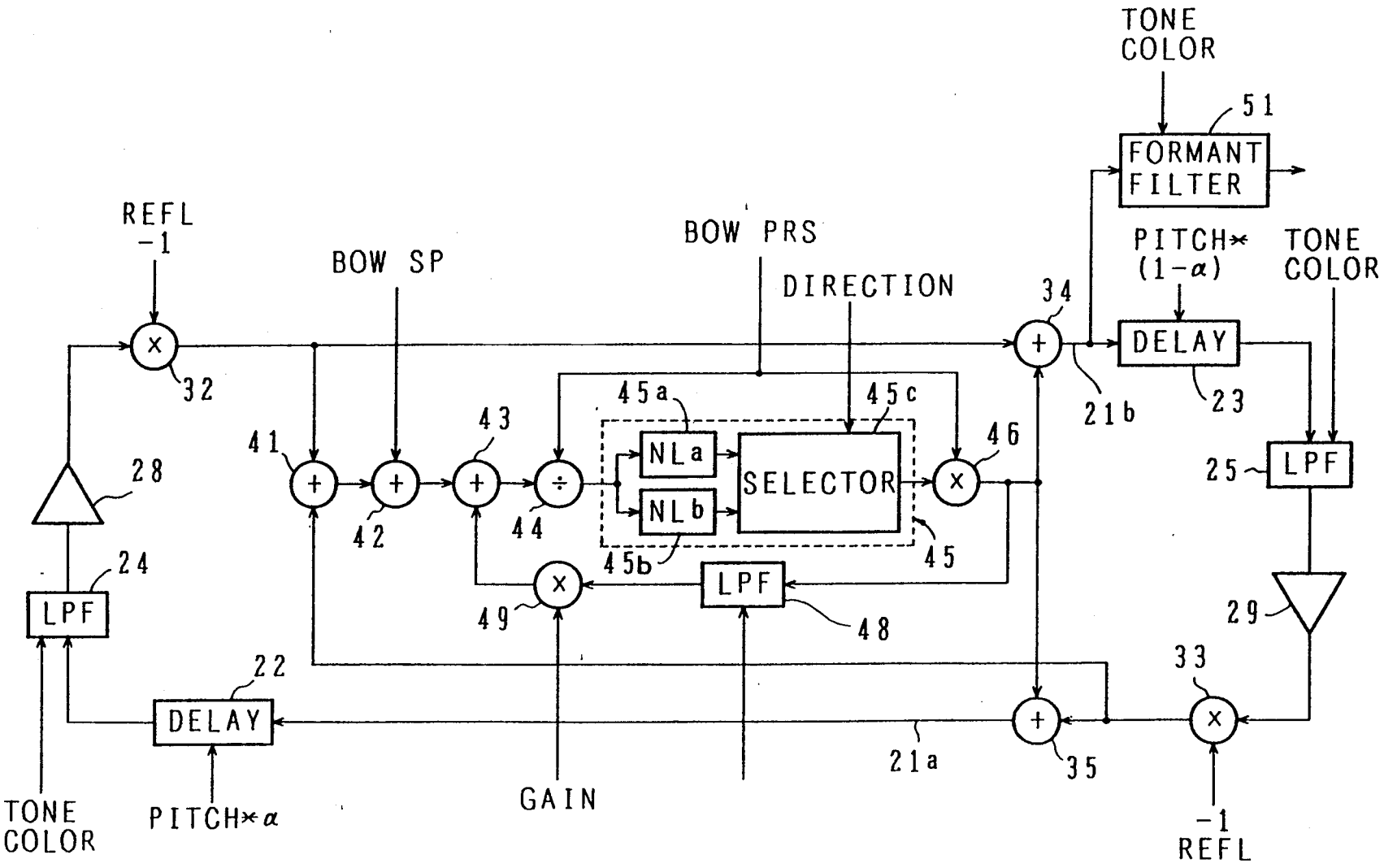
FIG. 2 is a circuit diagram of a main part of a tone signal generating circuit 8 used in the electronic musical instrument of FIG. 1.

FIG. 2 is an equivalent circuit diagram showing a main part of a tone signal generating circuit 8 which constitutes a sound source model of a rubbed string instrument.

Corresponding to the rubbing action of a bow on a string of a rubbed string instrument, a bow speed signal is generated and inputted to an addition circuit 42. This bow speed signal is an initializing signal and supplied to a non-linear circuit 45 through an addition circuit 43 and a division circuit 44. The non-linear circuit 45 is a circuit for representing the nonlinear characteristic of a string of the violin. The non-linear circuit 45 include a first non-linear circuit NLa 45*a* which represents the characteristic when the bow is moving downwards, a second non-linear circuit NLa 45*a* which represents the characteristic when the bow is moving upwards, and a selector circuit 45*c* which selects which output of the two non-linear circuits is to be employed. The selector circuit 45*c* is controlled by the direction signal.

Figure 3A:
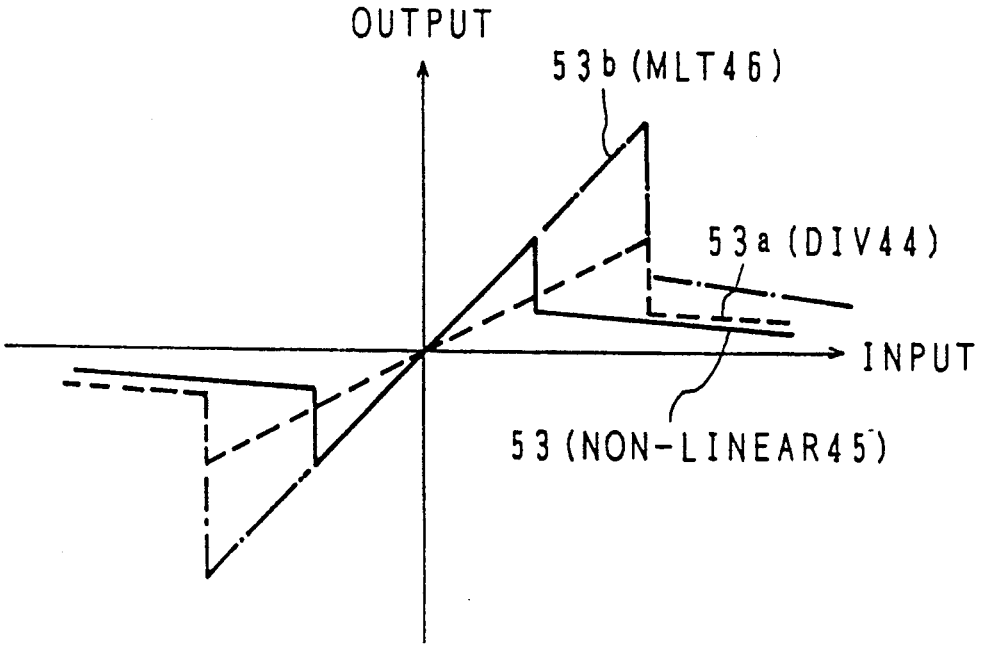

The non-linear characteristics of the non-linear circuit 45*a* and 45*b* include, as is shown in FIG. 3A, a substantially linear region from the origin to certain points and the outer regions of changed characteristic. When the string of a rubbed string instrument such as violin is rubbed by the bow, as long as the bow speed is slow, displacement of the bow is almost equivalent to the displacement of the bow, and the movement of the bow can be represented by the term of the static friction coefficient. This phenomenon is represented by the substantially linear characteristic region centering around the origin. When the relative speed of the bow with respect to the string exceeds a certain value, the velocity of the bow and the displacement velocity of the string are no longer the same. Namely, the dynamic friction coefficient determines the movement, in place of the static friction coefficient. This change from the static friction coefficient to the dynamic friction coefficient is represented by the step portion.

In FIG. 2, the output of the non-linear circuit 45 is supplied to two addition circuits 34 and 35 through a multiplication circuit 46.

The division circuit 44 on the input side and the multiplication circuit 46 on the output side of the non-linear circuit 45 receive the bow pressure signal and modify the characteristic of the non-linear 45. The division circuit 44 on the input side changes the input signal to a smaller value by dividing the same. Namely, as shown by the broken line 53*a* of FIG. 3A, when there is connected the division circuit 44, even when a large input is applied, an output as if the input was small is generated. The multiplication circuit 46 on the output side plays the role of increasing the output of the non-linear circuit 45. Namely, the multiplication circuit 46 increases the characteristic 53*a* produced by the division circuit 44 and the non-linear circuit 45 to a larger value of the output to produce a characteristic 53*b*. Here, upon the same bow pressure signal, first dividing the input and then multiplying the output represents dividing a characteristic by a coefficient C0 in the division circuit 44 and multiplying the result with the same coefficient C0 in the multiplication circuit 46. In this case, the total characteristic 53*b* of a dotted broken line lies on the extension of the characteristic 53 which is produced solely by the non-linear circuit 45, and has a shape which is multiplied by C0 both in the abscissa direction and in the ordinate direction. It is also possible to differentiate the coefficient of the multiplication circuit from the coefficient of the division circuit, to form a different shape.

Addition circuits 34 and 35 are provided in the circulating signal paths 21*a* and 21*b*. This circulating signal path 21 constitutes a closed loop for circulating the tone signal, corresponding to the string of the rubbed string instrument. Namely, in the string, the vibration is reflected at the both ends and goes back and forth. This behavior is approximated by a closed loop in which a signal circulates. This circulating signal path includes two delay circuits 22 and 23, two low pass filters (LPF) 24 and 25, two decay circuits 28 and 29, and two multiplication circuits 32 and 33. Each of the delay circuits 22 and 23 receives the product of the pitch signal representing the tone pitch and the coefficient $\alpha$ or $(1-\alpha)$ and gives a predetermined delay time. The total delay time required for a signal to circulate the circulating signal paths 21*a* and 21*b* and return to the original position determines the basic pitch of the tone signal. Namely, the sum of the delay times of the two delay circuits 22 and 23, pitch x $\{\alpha+(1-\alpha)\}$=pitch, mainly determines the basic pitch. One delay circuit corresponds to the distance from the position where the bow touches the string to the bridge, and the other corresponds to the distance from the position where the bow touches the string to the position where a finger depresses the string.

Although the pitch is mainly determined by the delay circuits 22 and 23, other factors included in the circulating signal path such as LPF 24 and 25, decay controls 28 and 29 also produce delays. Strictly, the exact factors for determining the pitch of the tone signal to be generated is the sum of the total delay times included in the loop.

The LPFs 24 and 25 simulate the vibration characteristics of various strings, by modifying the transmission characteristics of the circulating waveform signal. A tone color signal is generated by selecting a tone color pad 2b on the keyboard, etc. and supplied to the LPFs 24 and 25 to change over the characteristic to simulate the musical sound of the desired rubbed string instrument.

When the vibration is transmitting on the string, the vibration gradually decays. The decay controls 28 and 29 simulate these decays of the vibration transmitting on the string.

The multiplication circuits 32 and 33 multiply the reflection coefficient $-1$ in correspondence to the reflection of the vibration at a fixed end of the string. Namely, assuming the reflection at the fixed end without decay, the amplitude of the string is changed to the opposite phase. The coefficient $-1$ represents this opposite phase reflection. Decays in the amplitude at the reflection is incorporated in the decays in the decay controls 28 and 29.

In this way, the motion of the string of the rubbed string instrument is simulated by the vibration circulating on the circulating signal paths 21a and 21b which correpond to the string.

Further, the motion of the string of a rubbed string instrument has hysteresis characteristic. For simulating the hysteresis, the output of the multiplication circuit 46 is fed back to the input of the non-linear circuit 45 through the LPF 48 and the multiplication circuit 49. The LPF 48 serves to prevent oscillation of the feedback loop.

Letting the input from the addition circuit 42 to the addition circuit 43 be u, the input from the feedback path to the addition circuit 43 be v, and the amplification factor of the division circuit 44, the non-linear circuit 45 and the multiplication circuit 46 in total be A, the output w of the multiplication circuit 46 can be represented by $(u+v)A=W$. Letting the gain of the negative feedback loop including the LPF 48 and the multiplication circuit 49 pB, the amount of feedback v is represented by $v=wB$. Arranging these two equation, $$(u+wB)A=w,\ w=uA/(1-AB).$$

In the case of no feedback, i.e. $B=0$, the output w can be simply represented as $w=uA$, representing that the input u is simply multiplied by a factor A and is outputted. When there is negative feedback of a gain B, for obtaining an output of the same magnitude, an input $(1-AB)$ times (B is negative) as large as the case of $B=0$ should be applied.

Figure 3B:
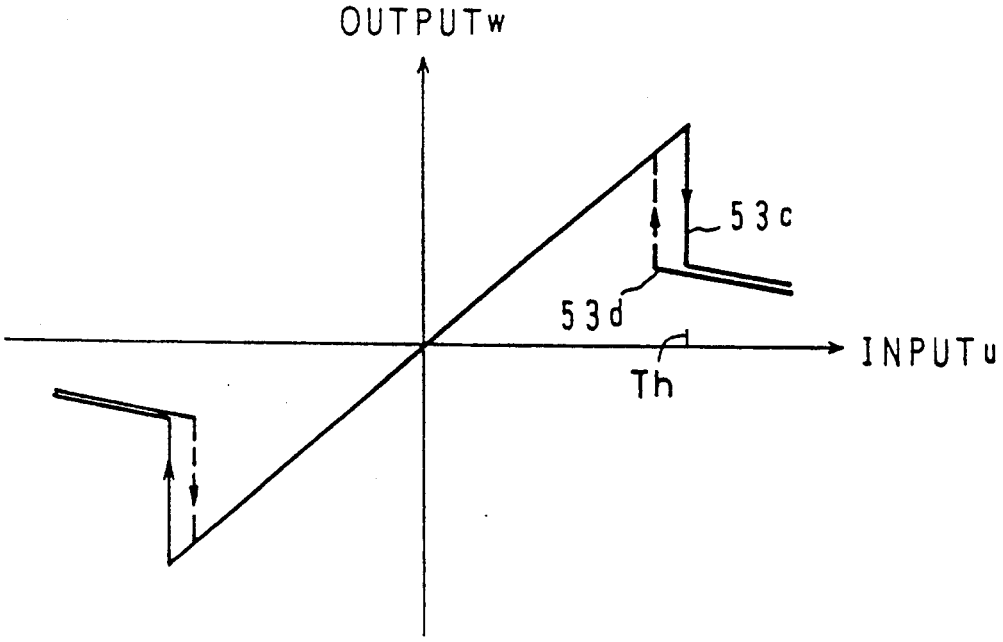

The characteristic when the input is increasing and there is such feedback is represented by curve 53c in FIG. 3B. When the input increases to a certain value, there occurs transition from the static friction coefficient to the dynamic friction coefficient and the output decreases stepwise. This threshold value is shown by Th.

In case when the input has once exceeded the threshold value Th and then decreases to a smaller value again, the output w is small and hence the feedback amount $v=Bw$ is also small. Namely, even if the magnitude of the signal inputting to the non-linear circuit 45 is the same, the negative feedback amount is small in the case of the dynamic friction coefficient region compared to the static friction coefficient region and hence the input u from the addition circuit 42 to the addition circuit 43 becomes smaller.

Let us consider the magnitude of the input u from the addition circuit 42 when the input to the non-linear circuit 45 becomes the threshold value. When the input is increasing, the static friction coefficient dominates the motion, a strong negative feedback is applied corresponding to a large output, and hence the transition occurs at a larger input Th. When the input is decreasing, the dynamic friction coefficient dominates the motion, the negative feedback is small corresponding to a small output, and hence the transition occurs at a smaller input value u. Therefore, the relation between input u and the output w when the input is gradually increasing and when the input is gradually decreasing can be represented as in FIG. 3B, where the characteristic curve 53c and another characteristic 53d represent the increasing and the decreasing characteristics which jointly form a hysteresis characteristic. The magnitude of hysteresis is controlled by the gain of the multiplication circuit 49.

In this way, according to the tone signal generating circuit shown in FIG. 2, the motion of the string of a rubbed string instrument can be simulated and a basic waveform of the tone signal can be produced.

An output is derived from some point in the circulating signal paths 21a and 21b as shown in FIG. 2 and is supplied to the sound system through a formant filter 51 which simulates the characteristic of the belly of a rubbed string instrument.

It can also be arranged that formant filter 51 varies the characteristics upon reception of a tone color signal.

In the tone signal generating circuit shown in FIG. 2, the signal having the motive power for generating the tone signal is given by the bow speed. Also, bow pressure is used as the signal for controlling the characteristic of the non-linear circuit 45. Also, the characteristic of the non-linear circuit 45 itself is controlled by the moving direction of the bow. Namely, it is preferable to afford the bow speed, the bow pressure and the direction as the basic parameters for simulating the musical sounds of a rubbed string instrument. It is preferable that these parameters are controllable based on the player's will or the performance manipulation of a player. The parameter for designating the tone pitch can be derived by manipulating a key 2a in the keyboard 2, but information on the bow speed, the bow pressure and the direction cannot be obtained from the keyboard. Therefore, the system of FIG. 1 employs the plane manipulator 1. The plane manipulator 1 includes, for example, a tablet 1a and a hand manipulator 1b.

Figure 4A:
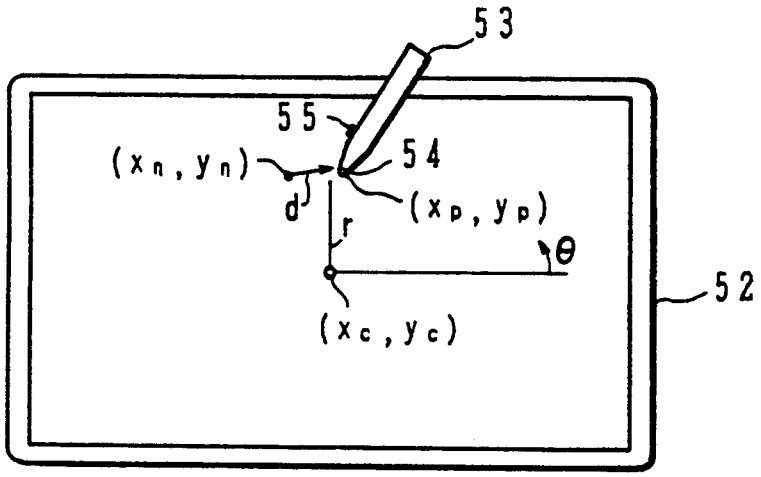
FIGS. 4A and 4B are schematic diagrams for illustrating an example of the configuration and the function of the performance manipulator.
Figure 4B:
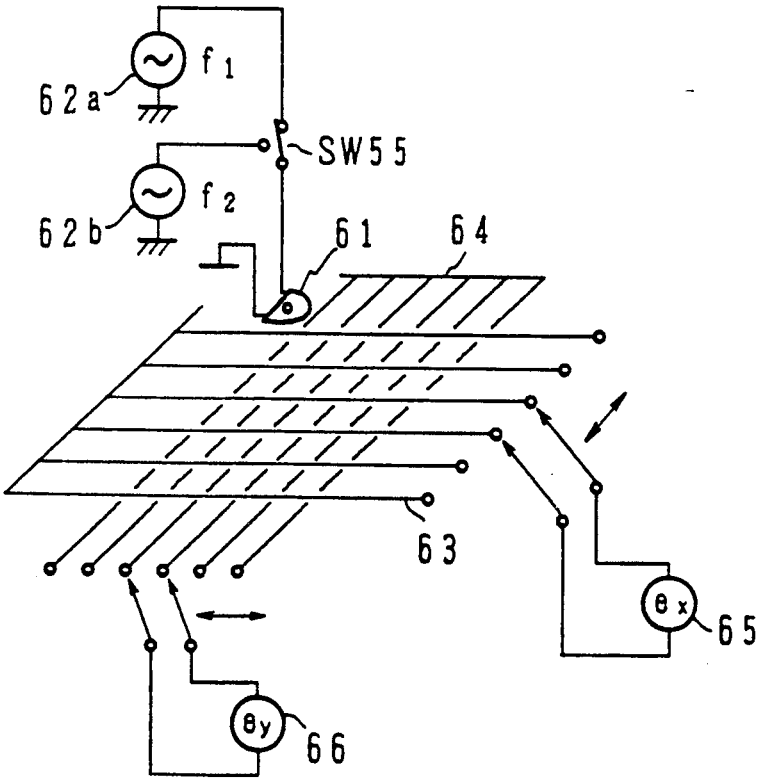

FIGS. 4A and 4B show structural examples of the tablet of the plane manipulator.

FIG. 4A is a schematic plan view showing a configuration for manipulating the plane manipulator. A tablet 52 has a manipulation region capable of detecting the position in the region. The pen manipulator 53 to be used in combination with this tablet 52 has a pen point 54 which is to be manipulated while contacting the tablet 52, and also has a switch 55. Further, a reference point having coordinates (xc, yc) is set in the manipulation region of the tablet 52. Also, a reference axis direction is set at a direction passing through the reference point. By performance-manipulating the pen manipulator 53 in the manipulation region of the tablet 52, there are produced a speed information from the moving distance d, a pressure information from the distance r from the reference point and a direction information from the angle $\theta$ from the direction of the reference axis, as will be described later.

An example of the electronic circuit to be incorporated with such a plane manipulator is shown in FIG. 4B.

FIG. 4B shows an electromagnetic induction type position detecting plane manipulator. The pen manipulator has an ac power source 62*a* of a frequency f1, another ac power source 62*b* of another frequency f2, a coil 61 and a switch SW 55, and generates an ac magnetic field of a frequency f1 or f2.

By approaching the coil 61 to the tablet, an ac magnetic field is established in the tablet plane. In the tablet, there are disposed a plurality of X direction detection lines 63 which are aligned along X direction and has each one end connected in common, and a plurality of Y direction detection lines 64 which are alined along Y direction and has each one end connected in common. At the open end of these detection lines, detectors 65 and 66 are connected to the adjacent detection lines of X direction and adjacent detection lines of Y direction respectively and are successibly scanned. Namely, since an ac magnetic field is generated in the neighborhood of the coil 61 of the pen manipulator, an induction current is induced in the detection lines therebelows. By detecting this induction current in the detectors 65 and 66, the frequency of the ac magnetic field generated by the coil of the pen manipulator and the manipulation position of the pen manipulator are detected. The change-over of the frequency f1 and f2 represents, for example, the arco performance and the pizzicato performance. The information of the manipulation position produces, by processings described below, the speed information, the pressure information and the direction information.

The pressure of the actual manipulation is also detected by providing a pressure sensor such as a pressure sensitive conductive sheet under the position detecting means. Namely, there are provided two kinds of pressure informations. When the pen point 54 of the manipulator 53 is moved while contacting the manipulation region of the tablet, the position of manipulation is detected in time sequence according to the timer interrupt.

Now, let us assume here that the position of the pen point 54 now is (xp, yp), and the position at the previous timer interrupt is (xn, yn). Then the distance d from the position at the previous timer interrupt to the position at the present timer interrupt and the distance r from the reference point (xc, yc) to the position of the present timer interrupt (xp, yp) are calculated.

Also, a reference axis is set from the reference point (xc, yc) to the rightward direction as shown in the figure. An angle $\theta$ between the line connecting the reference point (xc, yc) to the position of manipulation (xp, yp) and the reference axis is calculated. With respect to this angle data $\theta$, there is also stored an angel $\theta n$ with respect to the position of the previous timer interrupt. From the difference between the angles at a present timer interrupt and the previous timer interrupt, the direction of the angel change is derived.

A speed information, a pressure information and a direction information can be produced by utilizing these parameters.

Then, a flow chart of tone signal formation in the case of performing a rubbed string instrument by utilizing a structure as described above will be described. It is assumed here that a mode switch 6 for selecting the mode of the pressure information detection is a circulating type switch in which two states alternatively appears upon repeated manipulation.

Figure 5:
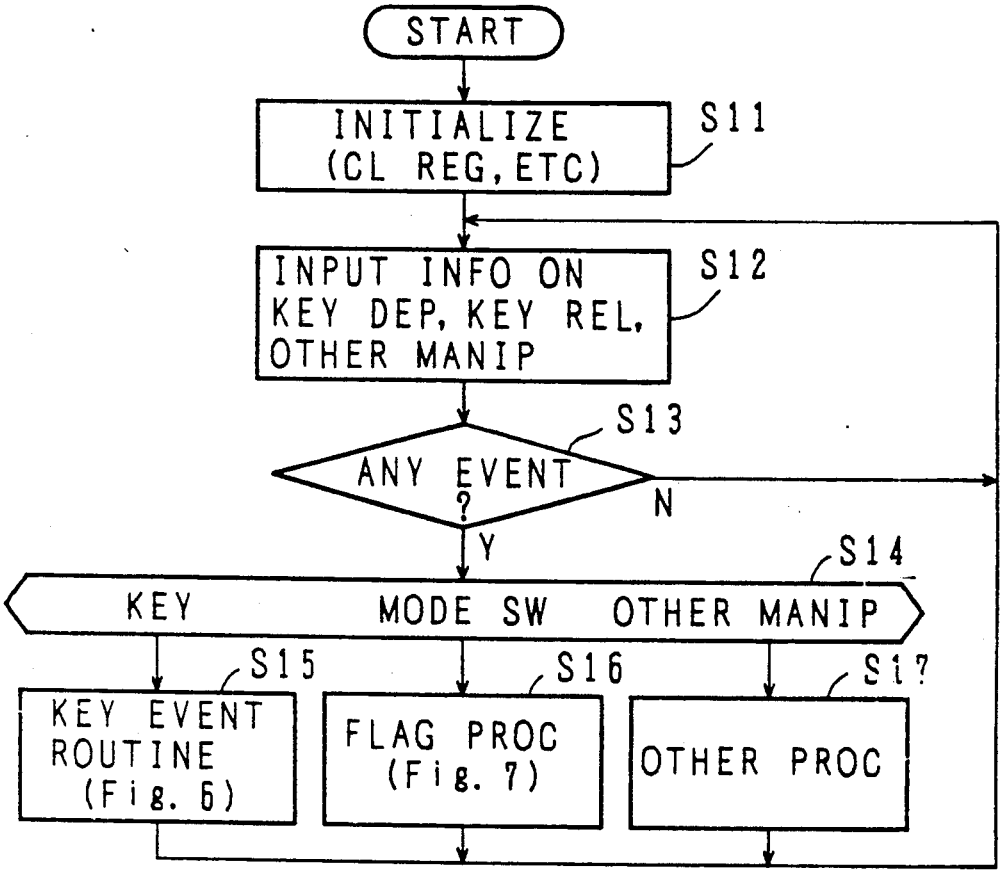
FIG. 5 is a flow chart of the main routine.

First, main routine is shown in FIG. 5. When the main routine is started, initialization is done in step S11. For example, clearing of the respective registers is done. In the next step S12, information of key depression and key release in the keyboard and the information on the manipulation of the respective manipulators such as plane manipulator, etc. are detected and inputted.

When the performance manipulation information is inputted, it is discriminated whether an event or events have occurred or not, in step S13.

If there is an event, the flow goes to step S14. In step S14, it is discriminated whether there is a key event or not, whether the mode switch is manipulated or not, and whether other manipulators are manipulated or not. If there is a key event, the flow goes to the key event routine of step S15.

When the mode switch is manipulated, the flag processing of step S16 is done. Also, when any one of the other manipulators is manipulated, the corresponding processing is done in step S17.

After these processings (steps S15, S16 and S17), the flow goes back to step S12. If there is no event in step S13, the flow also goes back to step S12.

Figure 6:
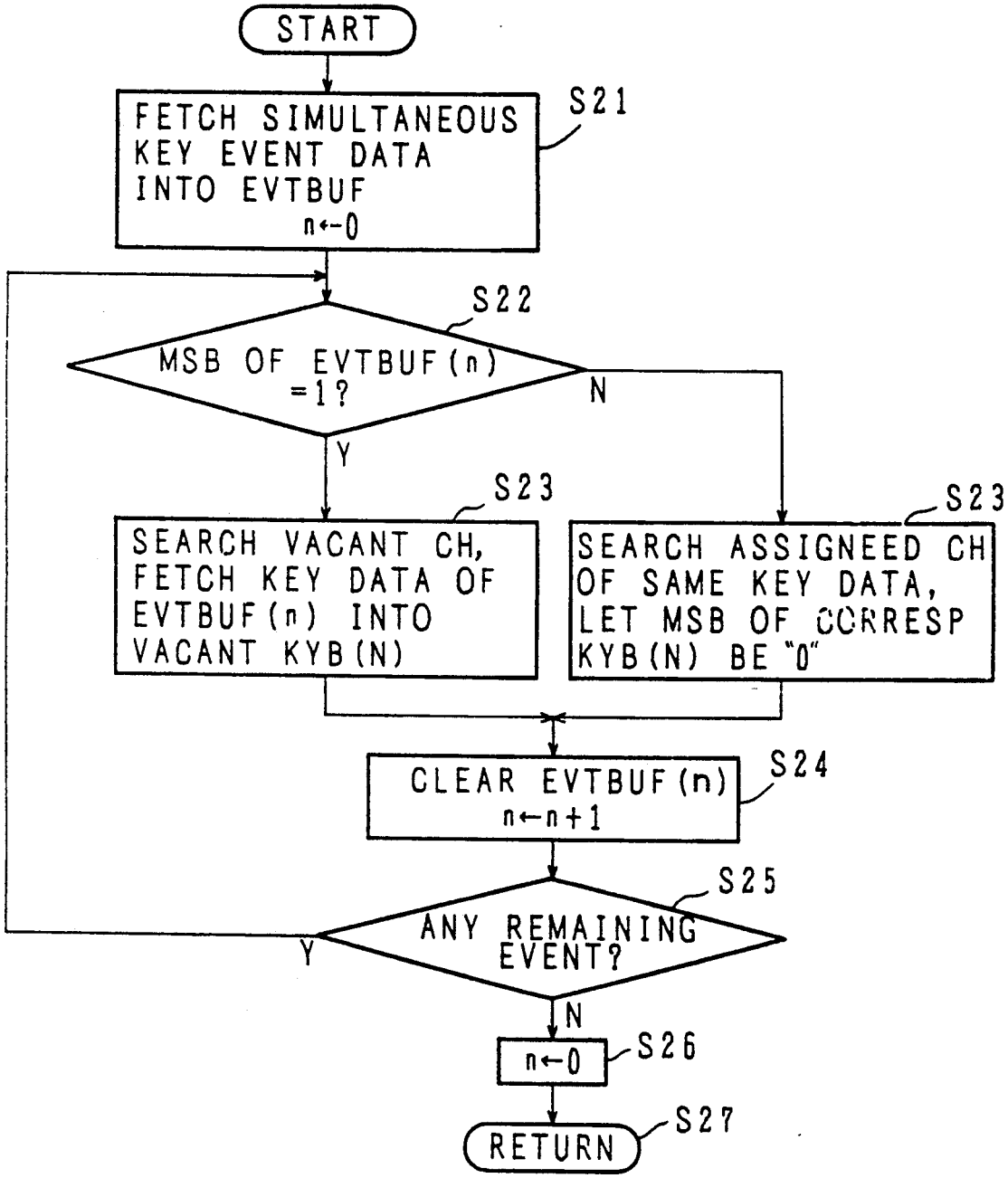
FIG. 6 is a flow chart of the key event routine.

FIG. 6 shows the key event routine. When the key event routine is started, in step S21, data of key events which have occurred simultaneously are fetched into event buffer registers EVTBUF and "0" is set in the numbering resister n.

Next in step S22, it is discriminated whether MSB of the n-th (first 0-th) event buffer register EVTBIF(n) is "1" or not. The fact that MSB is 1 indicates a depressed key state in which a key is depressed. The fact that MSB is "0" indicates a released key state. If MSB is "1", the flow goes to the next step S23 along the arrow Y.

In step S23, vacant channels are searched for inputting the key depression data. The key data of the event buffer register EVTBUF(n) are fetched to a vacant key buffer KYB(n).

In the present embodiment, when there is no vacant channel, channel assignment will not be done. However, the channel assigned most oldly may be searched as described below, and the old data may be rewritten by the key depression data successively.

Then, the event buffer register EVTBUF(n) which has finished data transfer of the key data is cleared. Then the number n is counted up by one, n+1 (step S24).

In the next step S25, it is checked whether there are remaining event data in the event buffer register or not. If there is no remaining data "b 0" is set in the number n to terminate the processing (step S26), and the flow returns (step S27).

When there is any remaining event in the event buffer register, the flow goes back from the step S25 to step S22.

In step S22, if MSB of the n-th event buffer register EVTBUF(n) is "0", the flow goes to step S28 and a channel assigned with the same key data is searched for. Namely, MSB="0" means key release and for realizing key release a key depression should exist beforehand. Therefore, a key buffer which stores the depressed key data is searched for. When the channel assigned to the depressed key data is searched, the associated key buffer KYB(N) corresponding to the key release is cleared and the corresponding musical sound is terminated.

In the present embodiment, for generating a musical sound, it is necessary that any one key in the keyboard is depressed and the movable manipulator touches the manipulation plane in the plane manipulator. In an electronic musical instrument which requires two conditions of key depression and manipulation of the movable manipulator as the condition for generating a sound, the musical sound will be erased when the key is released. Clearing of KYB corresponds to the key release.

Here, in case when an assignment system is employed in which the most oldly assigned key data is successively rewritten as will be described latter, processing corresponding to the key release event may be dispensed with and manipulation of a pen manipulator may be employed as the sole condition for generating musical sound.

Figure 7:
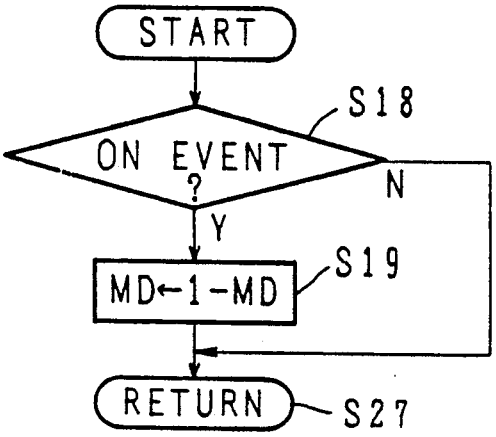
FIG. 7 is a flow chart of the mode switch routine.

FIG. 7 shows a processing routine of the mode switch. When the pen switch is manipulated, it is discriminated in step S18 whether it is an on event or not. If it is an on event, "1−MD" is set in the register MD in step S19. Namely, the state is inverted. If it is not an on event, step S19 is skipped over. Then the flow returns (step S27).

Figure 8:
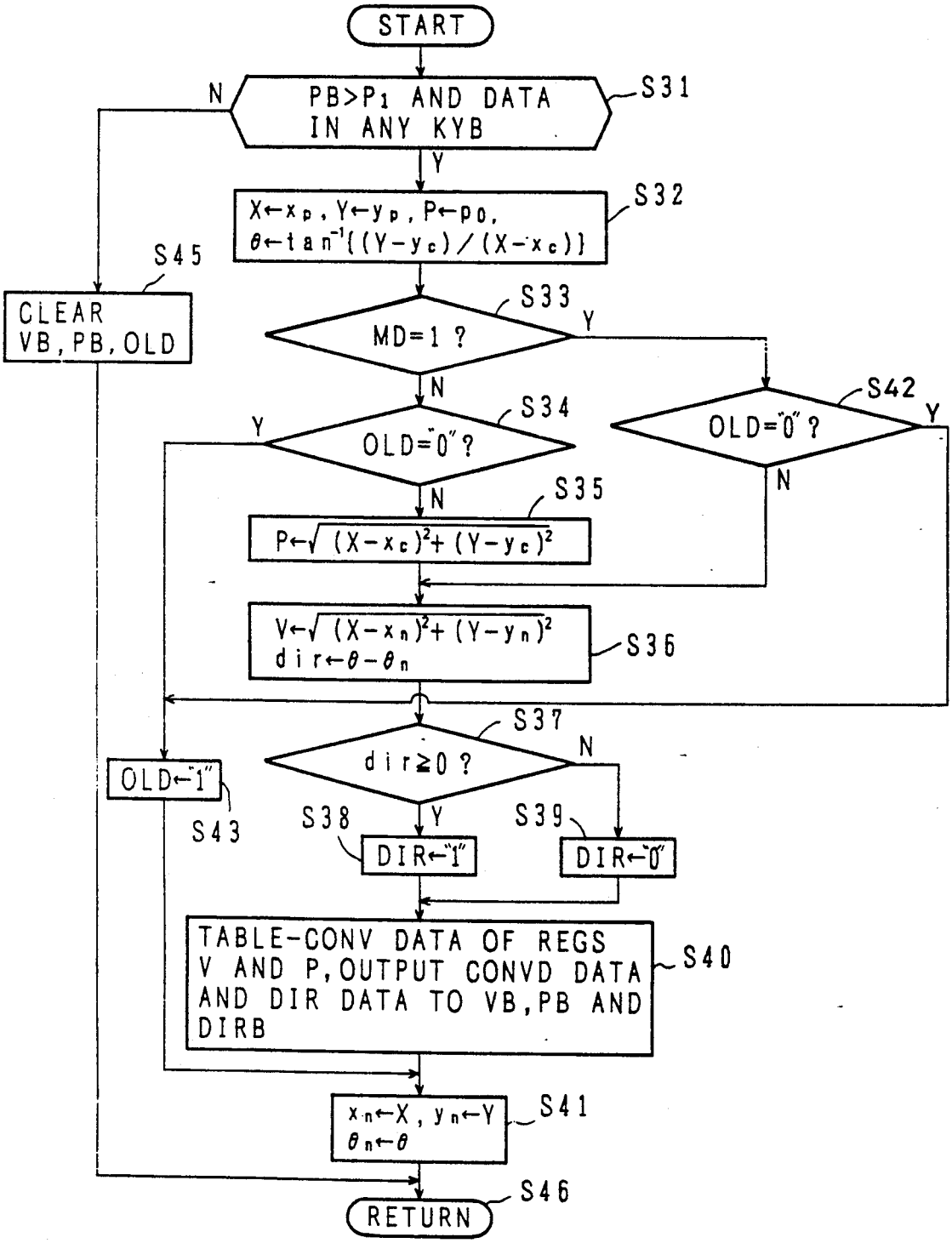
FIG. 8 is a flow chart of the timer interrupt routine.

Next, timer interrupt routine will be described referring to FIG. 8. First, when the timer interrupt has occurred, it is checked in step S31 whether the pressure data PB stored in a pressure buffer is greater than a predetermined pressure P1 and there is data in any of key buffers KYB. In this state, the pressure detected in the plane manipulator itself is stored in the pressure buffer PB. The constant P0 is set at a very small pressure value. Namely, when pressure is applied to the plane manipulator and any key in the keyboard is depressed, a musical sound will be generated. Here, the condition whether there is data in any of key buffers KYB may be removed. In other words, it is arranged that no musical sound will be generated only by key depression nor by manipulation on the plane manipulator, thereby preventing sound generation by erroneonus action.

When the both conditions are satisfied, in the next step S32 along arrow Y, coordinates xp and yp and pressure P0 which are the outputs of the plane manipulator 1 are fetched to the respective registers X, Y and P. Also, letting x axis as the reference axis, the angle $\theta$ of the position of manipulation (X, Y) with respect to the reference point is obtained from the value of tangent, $\{(Y-yc)/(X-xc)\}$. In the next step S33, it is discriminated whether the data in the register MD is "1" or not.

When MD is not "1", the mode where the pressure detected by the pressure sensor is not used is indicated. And, another pressure data calculated from the processings as will be described below is used as the pressure data in the formation of the tone signal. Namely, the flow goes to step S34 along arrow N, and it is discriminated whether flag OLD is "0" or not. If the event is new, the flag is still "0". Then, the flow goes to step S43, and "1" is set in the flag OLD.

When the flag is already set, the flow goes to step S35 and the distance from the reference point (xc, yc) to the position of manipulation (X, Y), $\{(X-xc)^2+(Y-yc)^2\}^{\frac{1}{2}}$, is stored in the register P as the pressure data. Namely, the pressure P0 detected in the plane manipulator and has been stored in the register P is renewed with the new pressure data.

When MD is "1" is step S33, it is the mode where the pressure detected in the plane manipulator is used directly. Then, it is discriminated whether flag OLD is "0" or not in step S42. If it is not "0", the flow joins after step S35. Namely, the detected pressure P0 remains in the pressure register P. If flag OLD is "0" in step S42, it indicates the first phenomenon, and the flow goes to step S43 where "1" is set in the flag OLD.

Following step S35, the speed data and the direction data are set in the next step S36. Namely, the distance from the position at the previous timer interrupt (xn, yn) to the position of the current timer interrupt (X, Y), $\{(X-xn)^2+(Y-yn)^2\}^{\frac{1}{2}}$, is stored in the register V. The timer interrupt occurs at a constant interval, for example, at 3 msec. Thus, the moving distance is proportional to the velocity.

Also, the difference in the angle between the angular position $\theta$ at the current interrupt and the angle position $\theta n$ at the previous timer interrupt, $(\theta-\theta n)$, is stored in the register dir as the direction data. This defference in the angle is proportional to the angular velocity. Next, it is discriminated in step S37 whether the data in the register dir is positive (or 0) or not. If it is positive or 0, the angular motion is counter-clockwise. Then, along arrow Y, "1" is set in the register DIR in step S38. Also, if dir is negative, the angular motion is clockwise and "0" is set in DIR in step S39, following arrow N.

Then, in step S40, the velocity data in the register V and the pressure data in the register P are table-converted, and these converted data and the direction of DIR are supplied to registers VB, PB and DIRB. In this way, data are stored in the velocity buffer, pressure buffer and direction buffer of the tone signal generating circuit.

Then, in step S41, the current position (X, Y) is stored in the previous position (xn, yn). Namely, the position coordinates are renewed. Similarly, the angular data $\theta n$ is renewed to a new value $\theta$. Then, the flow returns in step S46.

When either of the two conditions does not hold in step S31, the flow goes along arrow N. In step S45, the velocity buffer VB, the pressure buffer PB and flag OLD, etc. are cleared. Then, the flow returns in step S46.

The timer interrupt occurs at a constant time interval, for example, at every 3 msec. The moving distance in a constant time interval is proportional to the velocity. In the above processings, the moving distance between timer interrupts is utilized as the velocity data.

The pressure of the pressure sensor in the plane manipulator or the pressure data calculated from the position of performance manipulation in the plane manipulator, is utilized as the pressure information by the selecting manipulation in the mode switch, and the musical sounds of a rubbed string instrument are generated. For a beginner player, for example, it may be easier to manipulate the pen manipulator to draw a circle around the reference point with a preferred radius than to apply a predetermined pressure through the pen manipulator. In such a case, the pressure data detected in the pressure sensor is not used as the pressure information and the distance from the reference point is utilized as the pressure information to achieve the performance of a rubbed string instrument.

In the above-mentioned embodiments, the existence of a pressure on the plane manipulator and depression of a key in a keyboard constitute conditions for generating a musical sound. However, in case of playing on a keyboard, when the tone pitch jumps widely, it is inevitable that the key depressing finger instantly departs from the key in the performance. In the performance of a rubbed string instrument, however, tones having widely separated tone pitches may be continuously played by rubbing adjacent strings. Alternative embodiments will be described referring to FIGS. 9A and 9B which can respond to such situation.

Figure 9A:
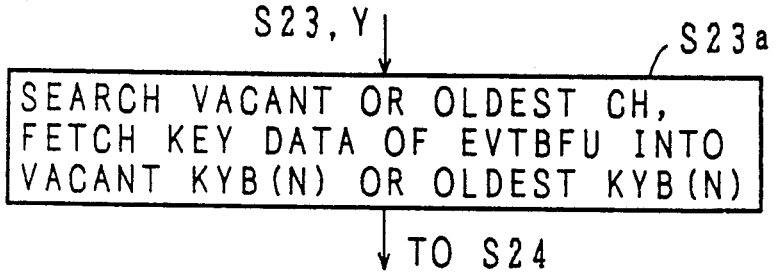
FIGS. 9A and 9B is a flow chart illustrating an alternative embodiment.

FIG. 9A shows an alternative embodiment of a key event routine which is to be done in the key event routine described in connection with FIG. 6 when the number of key events is large and there is no vacant channel. Namely, step S23*a* is used in place of step S23. A vacant channel is searched for and if there is a vacant key buffer KYB(N), the key data is fetch therein. When there is no vacant key buffer, the oldest channel is searched for and the key data in key event buffer EVTBUF is fetched into that key buffer KYB(N).

Figure 9B:
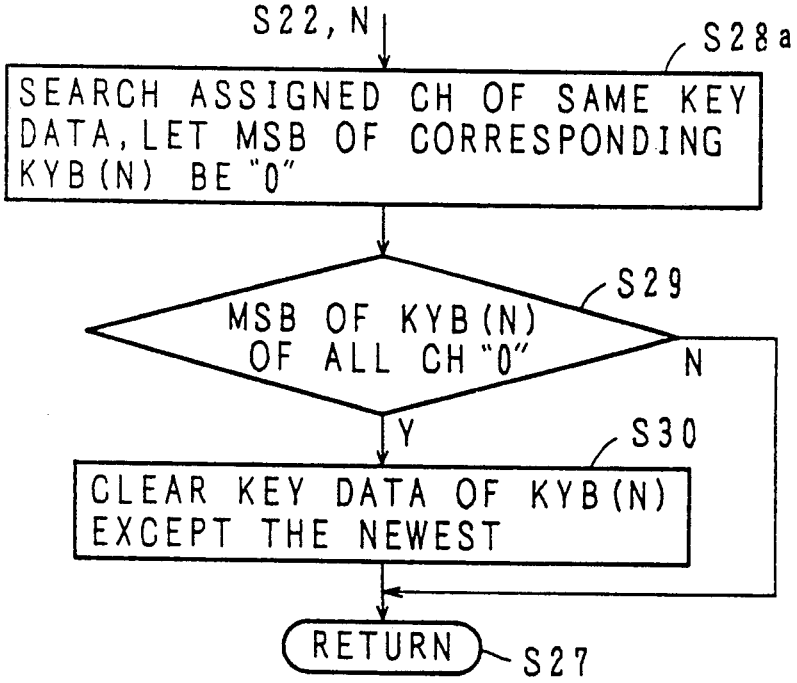

When, in step S22 of FIG. 6, MSB is "0", processing of step S28*a* and on shown in FIG. 9B may be done in place of step S28 on. Namely, when MSB is "0" and a key in the keyboard in released, the channel assigned with the same key data is searched for and MSB of the corresponding key buffer KYB(N) is set to "0". By this step, the key release is registered.

Next, in step S29, it is checked whether MSBs of key buffers KYB(N) of all the channels are "0" or not.

If MSBs of all the channels are "0", in the next step S30 along arrow Y, key data except those of the key buffer KYB(N) of the newest channel are cleared. Namely, information of the newest key buffer KYB(N) remains. By this action, the musical sound continues to be generated according to the newest key release information. Namely, when separated position in the keyboard is to be played continuously, and even if the finger inevitably departs from the keyboard, the musical sound of the rubbed string instrument is continuously generated.

In step S29, if any MSB of the key buffer KYB(N) is not 0 and is "1", step S30 is skipped over along arrow N and the flow returns (step S27).

Although description has been made on the performance of a rubbed string instrument, taking the case of the violin as an example, musical sounds of other instruments can be generated using the similar electronic musical instrument.

For example, for generating the musical sound of a wind instrument, breath pressure may replace the pressure data and embouchure may replace the velocity data.

The correspondence or interrelation between the tone signal controlling parameter and the information detected or calculated from the plane manipulator or hand manipulator may be arbitrarily.

Although description has been made on the case where the plane manipulator is provided with a pressure sensor and the modeswitch selectively selects the real pressure or the pressure calculated from the manipulation position, the pressure sensor may be incorporated in the pen manipulator. It is also possible that the plane manipulator is not provided with a pressure sensor and the pressure calculated from the position of manipulation is solely used. In this case, the mode switch is not necessary.

Also, although the description has been made on the manipulator having electromagnetic coupling type two dimensional manipulation region, the manipulation region is not limited thereto.

For example, it is also possible to use such manipulators as one which use a light pen and a light sensitive display surface, and one which inputs the data in three dimensions utilizing the polar coordinates, etc. The reference point may be fixed or arbitrarily settable.

Also, other hand manipulators than the pen type manipulator may also be used.

Also, waveform memory tone generator, fm tone generator, etc. can be utilized as the tone generator as well as the physics model tone generator circuit as described above.

Sole use circuits for achieving the steps of the program may be used in place of the combination of CPU, ROM and RAM.

As is described above, according to the embodiments of this invention, there is provided a new parameter for controlling a tone signal by utilizing manipulation means having at least two dimensional manipulation region in which a reference point can be set and by calculating and utilizing the distance from the reference point to the position of performance manipulation.

By this information, for example, information of the bow pressure which the bow gives to a string in a rubbed string instrument can be similated.

Although description has been made on the selected embodiments of this invention, the present invention is not limited thereto. For example, it will be apparent for those skilled in the art that various alteration, modifications, improvements and combinations thereof are possible.

We claim:

1. An electronic musical instrument comprising:

manipulation means for achieving performance manipulation, having a manipulation region of at least two dimensions, and being capable of setting a reference point and one axis including said reference point to define an origin and a reference axis, respectively, in the manipulation region;

means for detecting a distance from said reference point to a position of performance manipulation and generating a distance signal based on the results of such detection;

means for detecting time variation of an angle formed between said reference axis and the direction connecting the position of performance manipulation and the origin and generating an angle change signal based on the results of such detection; and means for generating a musical tone signal based on at least one of said distance signal and said angle change signal.

2. An electronic musical instrument according to claim 1, further comprising:

means for detecting a velocity of said performance manipulation from time variation of the position of performance manipulation in said manipulation region and generating a velocity signal based on the results of such detection;

wherein said tone signal generating means is capable of generating a tone signal based on said distance signal and said velocity signal.

3. An electronic musical instrument according to claim 2, further comprising means for detecting pressure of said performance manipulation and for generating a pressure signal based on the result of detection, and said tone signal generating means is capable of generating a tone signal using the velocity and the pressure as parameters for controlling the signal.

4. An electronic musical instrument comprising:

manipulation means for achieving performance manipulation, having a manipulation region defined by a manipulation surface, and being capable of setting a reference point in the manipulation region;

distance detecting means for detecting a distance from said reference point to a position of performance manipulation and generating a distance signal based on the result of such detection;

pressure detecting means for detecting the amount of pressure of said performance manipulation and generating a pressure signal based on the result of such detection; and tone generating means for generating a musical tone signal based on at least one of said distance signal and said pressure signal, wherein said tone generating means includes feedback loop means for circulating a signal input therein, said feedback loop means having at least one delay unit, excitation means for generating an excitation signal which is input to said feedback loop means and non-linear conversion means for converting said excitation signal according to a non-linear function.

5. An electronic musical instrument according to claim 4, further comprising switch means for selecting either said distance signal or said pressure signal, wherein said tone generation means generates a musical tone signal based on a signal selected by said switch means.

6. An electronic musical instrument according to claim 1, wherein said tone signal generation means comprises:

feedback loop means for circulating a signal input therein, and including at least one delay unit;

excitation means for generating a excitation signal which is input to said feedback loop means; and non-linear conversion means for converting said excitation signal according to a non-linear function.

7. An electronic musical instrument comprising:

manipulation plate means for achieving performance manipulation, having a manipulation region defined by a manipulation surface and at least one reference point in said manipulation region;

distance detecting means for detecting a distance from the reference point to a position of performance manipulation and generating a distance signal based on the result of such detection;

pressure detecting means for detecting the amount of pressure of the performance manipulation and generating a pressure signal based on the result of such detection;

a loop in which a signal is repeatedly circulating;

first and second delay means to be provided within the loop, each delaying the signal supplied thereto;

mixing means for mixing a start control signal from an external device with the respective outputs of said first and second delay means and producing a mixed signal; and conversion means for effecting a non-linear conversion on the mixed signal and producing a converted signal, which is outputted do each of the first and second delay means; and tone generation means for generating a musical tone signal based on at least one of the distance signal and the pressure signal.

8. An electronic musical instrument according to claim 7, further comprising:

means for detecting a velocity of said performance manipulation from time variation of the position of performance manipulation in said manipulation region and generating a velocity signal based on the results of such detection, wherein said tone signal generating means is capable of generating a tone signal based on said distance signal and said velocity signal.

9. An electronic musical instrument according to claim 8, further comprising means for detecting the amount of pressure of said performance manipulation and for generating a pressure signal based in the result of such detection, wherein said tone signal generating means is capable of generating a tone signal based on said velocity signal and said pressure signal.

10. An electronic musical instrument comprising:

manipulation plate means for achieving performance manipulation, having a manipulation region defined by a manipulation surface and being capable of setting a reference point in said manipulation region;

distance detecting means for detecting a distance from the reference point to a position of performance manipulation on the manipulation surface and generating a distance signal based on the result of such detection;

pressure detecting means for detecting the amount of pressure of the performance manipulation and generating a pressure signal based on the result of such detection; and tone generation means for generating a musical tone signal simulating a rubbed string instrument based on at least one of said distance signal and said pressure signal.

11. An electronic musical instrument according to claim 10, further comprising:

means for detecting a velocity of said performance manipulation from time variation of the position of performance manipulation in said manipulation region and generating a velocity signal based on the results of such detection, wherein said tone signal generating means is capable of generating a tone signal based on said distance signal and said velocity signal.

12. An electronic musical instrument emulating a bowed string instrument, comprising:

manipulation means for achieving performance manipulation, having a manipulation region defined by a manipulation surface; and having a reference point in the manipulation region means for providing a bow pressure signal based on a first detected characteristic of performance manipulation within the manipulation region; and means for providing a bow velocity signal based on a second detected characteristic of performance manipulation with the manipulation region; wherein said first characteristic is a distance of performance manipulation from the reference point tone generation means for generating a musical tone signal based on said bow velocity signal and bow pressure signal, wherein said tone generating means responds to a variation of said first or second detected characteristics of performance manipulation by emulating the response of a bowed string instrument to a variation of a bowing pressure or a bowing velocity, respectively.

13. An electronic musical instrument as in claim 12, wherein said second detected characteristic is a velocity of performance manipulation within the manipulation region.

14. An electronic musical instrument as in claim 12, wherein said second characteristic is a time derivative of said distance of performance manipulation.

15. An electronic musical instrument as in claim 12, wherein said manipulation means is capable of setting a reference point and one axis including said reference point to define an origin and a reference axis, respectively, in the manipulation region, and further comprising:

means for providing a bowing direction signal based on the time variation of an angle formed between said reference axis and a direction connecting a position of performance manipulation and the origin; and tone generation means for generating a musical tone signal based on said bow velocity signal, bow pressure signal and bowing direction signal, wherein said tone generating means responds to a variation of said first or second detected characteristics of performance manipulation by emulating the response of a bowed string instrument to a variation of a bowing pressure or a bowing velocity, respectively, and responds to a change in the direction of time variation of said angle by emulating the response of a bowed string instrument to a change in a direction of bowing.

* * * * *